US008094175B2

(12) United States Patent
Yokoyama

(10) Patent No.: US 8,094,175 B2
(45) Date of Patent: Jan. 10, 2012

(54) THERMAL PRINTER

(75) Inventor: Yasumi Yokoyama, Chiba (JP)

(73) Assignee: Seiko Instruments Inc. (JP)

( * ) Notice: Subject to any disclaimer, the term of this patent is extended or adjusted under 35 U.S.C. 154(b) by 310 days.

(21) Appl. No.: 12/583,709

(22) Filed: Aug. 25, 2009

(65) Prior Publication Data

US 2010/0053297 A1 Mar. 4, 2010

(30) Foreign Application Priority Data

Aug. 28, 2008 (JP) ..... 2008-219800

(51) Int. Cl.
*B41J 11/00* (2006.01)

(52) U.S. Cl. ..... 347/220

(58) Field of Classification Search ..... 347/171, 347/220, 221, 222; 400/648, 649, 660.1, 400/670.2
See application file for complete search history.

(56) References Cited

U.S. PATENT DOCUMENTS

| | | | | |
|---|---|---|---|---|
| 6,567,113 | B2 * | 5/2003 | Louis | 347/222 |
| 6,765,602 | B2 * | 7/2004 | Mori | 347/220 |
| 7,973,812 | B2 * | 7/2011 | Masuda | 347/171 |

FOREIGN PATENT DOCUMENTS

| | | |
|---|---|---|
| EP | 0458461 | 11/1991 |
| EP | 0870620 | 10/1998 |
| EP | 1900538 | 3/2008 |
| JP | 63098451 | 4/1988 |

* cited by examiner

*Primary Examiner* — Kristal Feggins
(74) *Attorney, Agent, or Firm* — Adams & Wilks

(57) ABSTRACT

In order to place both ends of a platen roller in bearing portions of a frame to perform accurate printing on a recording sheet with improved operability, a thermal printer comprises: a pair of concave portions (10*d*) provided to a frame to receive both end portions of a roller shaft (13*e*) of a platen roller (13) when a cover (8) is in a closed state; a pair of lock arms for automatically engaging the roller shaft (13*e*) of the platen roller (13) with the concave portions along with an operation of closing the cover (8); and a connection mechanism (30) for turnably connecting the platen roller (13) to the cover (8), and is characterized in that an axis of rotation of the platen roller (13) in the connection mechanism (30) is contained in a plane passing through a midpoint between the pair of concave portions (10*d*) to be vertical to an axial direction of the concave portions (10*d*) and is arranged parallel to the cover (8).

2 Claims, 6 Drawing Sheets

THERMAL PRINTER

BACKGROUND OF THE INVENTION

1. Field of the Invention

The present invention relates to a thermal printer.

2. Description of the Related Art

Thermal printers of various types are provided at present in which printing is performed by pressing a heated thermal head against a special recording sheet which undergoes a color change when heat is applied thereto. In particular, the thermal printer is preferably used in printing variety of labels, receipts, and tickets because it is possible to perform the printing of smooth letters and various graphics without using toners, inks, or the like.

In general, the thermal printer includes a thermal head having a plurality of heat-generating elements, a platen roller for sandwiching the recording sheet with the thermal head, a motor for feeding the recording sheet by rotating the platen roller through a gear, and biasing members (such as coil spring or leaf spring) for pressing the thermal head against the recording sheet and the platen roller side. Further, the recording sheet used for the thermal printer is normally used in a state of being wound so as to have a hollow into roll paper.

For performing printing with the thermal printer described above, the thermal head is pressed against the recording sheet while the platen roller is being rotated by the motor to feed the recording sheet. Then, the heat-generating elements of the thermal head are operated based on information to be printed, thereby printing characters or graphics according to the information on the recording sheet passing between the thermal head and the platen roller. As a result, various types of printing as described above can be performed.

Incidentally, in the case where the thermal printer described above is incorporated into a portable information terminal or the like, a structure, in which the thermal head is provided on the side of a case for accommodating the roll paper therein, whereas the platen roller is provided on the side of a cover (lid member) capable of opening and closing an opening portion of the case (a so-called platen-open type structure), is common to easily sandwich the recording sheet pulled out from the roll paper between the thermal head and the platen roller when the roll paper is placed. Further, as described in patent document JP 2003-200624 A, for example, there is known a structure, in which lock arms for axially supporting the platen roller in a rotatable and attachable/removable manner are provided on side wall portions of a frame.

Here, for locking the platen roller provided on the cover side to the frame side, both end portions of a shaft of the platen roller must be locked to the lock arms when the cover is closed. However, when only one end side or the another end side of the cover in a width direction is pushed down, specifically, the cover corresponding to only one axial side of the platen roller is pushed down for closing the cover, a push-down force acts only on one side of the platen roller to bring about a so-called one-side locked state where only one side of the platen roller is locked. If the thermal printer is operated in this state, the recording sheet cannot be fed by the platen roller because the platen roller and the thermal head are not in even contact with each other. As a result, print processing is implemented in a state where precise printing cannot be performed on the recording sheet, and hence print information disappears to prevent the printing on the recording sheet.

SUMMARY OF THE INVENTION

On the other hand, when a portion of the lid member, which corresponds to the vicinity of the axial center of the platen roller or to both axial ends of the platen roller, is pushed down, both ends of the platen roller are substantially simultaneously locked to the lock arms to enable the platen roller to be reliably locked to the frame side. However, if the portion of the lid member, which corresponds to the vicinity of the axial center of the platen roller or to the both axial ends of the platen roller, is to be consciously pushed down for each operation of opening and closing the cover, operability is degraded. Moreover, it is difficult to judge whether or not the both ends of the platen roller are reliably locked after the cover is closed. More specifically, although a clicking engagement sound is made when the lock arms are engaged with the shaft of the platen roller, it is difficult to judge whether both sides are locked because the same sound is made in the case where one side is locked as well as in the case where both sides are locked. In addition, it is end-users that actually perform the operation of opening and closing the cover, and it is difficult to call the attention of even the end-users.

Therefore, the present invention is devised in view of the circumstances described above, and provides a thermal printer capable of reliably placing both ends of a platen roller in bearing portions of a frame to perform accurate printing on a recording sheet with improved operability.

In order to solve the above-mentioned problems, the present invention provides the following means.

A thermal printer of the present invention includes: a case having an opening portion for accommodating a recording sheet therein; a thermal head for performing printing on the recording sheet; a lid member capable of opening and closing the opening portion of the case; a platen roller provided to the lid member, for feeding the recording sheet through a rotation of the platen roller while sandwiching the recording sheet with the thermal head when the lid member is in a closed state; a frame provided in the case to support the thermal head; a pair of bearing portions provided to the frame to receive both end portions of a shaft of the platen roller when the lid member is in the closed state; a pair of lock arms for automatically engaging the shaft of the platen roller with the bearing portions along with an operation of closing the lid member; and a connection mechanism for turnably connecting the platen roller to the lid member, and is characterized in that an axis of rotation of the platen roller in the connection mechanism is contained in a plane passing through a midpoint between the pair of bearing portions to be vertical to an axial direction of the bearing portions and is arranged parallel to the lid member.

According to the structure described above, the platen roller is connected turnably to the lid member at the midpoint between the pair of bearing portions by the connection mechanism. Therefore, when one side of the lid member in the width direction is pressed down (in a closing direction), a push-down force for pushing down the lid member is transmitted through the connection mechanism without fail. As a result, even when a portion of the lid member other than the middle portion in the width direction is pushed down, the push-down force acts downward on an axial middle portion of the platen roller. Therefore, the platen roller is evenly pushed down at both end portions of the shaft. As a result, the both end portions of the platen roller can be substantially simultaneously locked along with the operation of closing the lid member. Specifically, whenever a clicking engagement sound is made, it can be judged that both sides are locked.

Therefore, by reliably locking the both end portions of the platen roller, the platen roller and the thermal head can be brought into even contact with each other. Thus, the recording sheet can be continuously fed by the platen roller. As a result, accurate printing with high precision can be performed on the recording sheet. Moreover, even when one side of the lid member in the width direction is pushed down, a one-side locked state as occurring in the conventional cases can be prevented. Therefore, it is not necessary to consciously push down the middle portion of the lid member in the width direction or to confirm the locked state after the closing operation. Therefore, the both end portions of the platen roller can be reliably locked to the bearing portions of the frame with improved operability.

Further, the thermal printer of the present invention is characterized in that the connection mechanism supports the platen roller movably along an axial direction of the axis of rotation.

According to the structure described above, the connection mechanism supports the platen roller movably along an axial direction of the axis of rotation. Therefore, a dimension error between the connection mechanism and the frame can be allowed. Specifically, even when the shaft of the platen roller and the bearing portions of the frame are misaligned in the width direction of the bearing portions when the operation of closing the lid member is performed, the connection mechanism slides in the axial direction to allow the both end portions of the platen roller to reliably move into the bearing portions. As a result, even when the dimension error is generated between the connection mechanism and the frame, the both end portions of the platen roller can be reliably locked to the bearing portions of the frame.

According to the thermal printer of the present invention, the platen roller is connected turnably to the lid member at the midpoint between the pair of bearing portions by the connection mechanism. Therefore, when one side of the lid member in the width direction is pressed down (in a closing direction), a push-down force for pushing down the lid member is transmitted through the connection mechanism without fail. As a result, even when a portion of the lid member other than the middle portion in the width direction is pushed down, the push-down force acts downward on an axial middle portion of the platen roller. Therefore, the platen roller is evenly pushed down at both end portions of the shaft. As a result, the both end portions of the platen roller can be substantially simultaneously locked along with the operation of closing the lid member. Specifically, when ever a clicking engagement sound is made, it can be judged that both sides are locked.

Therefore, by reliably locking the both end portions of the platen roller, the platen roller and the thermal head can be brought into even contact with each other. Thus, the recording sheet can be continuously fed by the platen roller. As a result, accurate printing with high precision can be performed on the recording sheet. Moreover, even when one side of the lid member in the width direction is pushed down, a one-side locked state as occurring in the conventional cases can be prevented. Therefore, it is not necessary to consciously push down the middle portion of the lid member in the width direction or to confirm the locked state after the closing operation. Therefore, the both end portions of the platen roller can be reliably locked to the bearing portions of the frame with improved operability.

DETAILED DESCRIPTION OF THE PREFERRED EMBODIMENT

Thermal Printer

Figure 1:
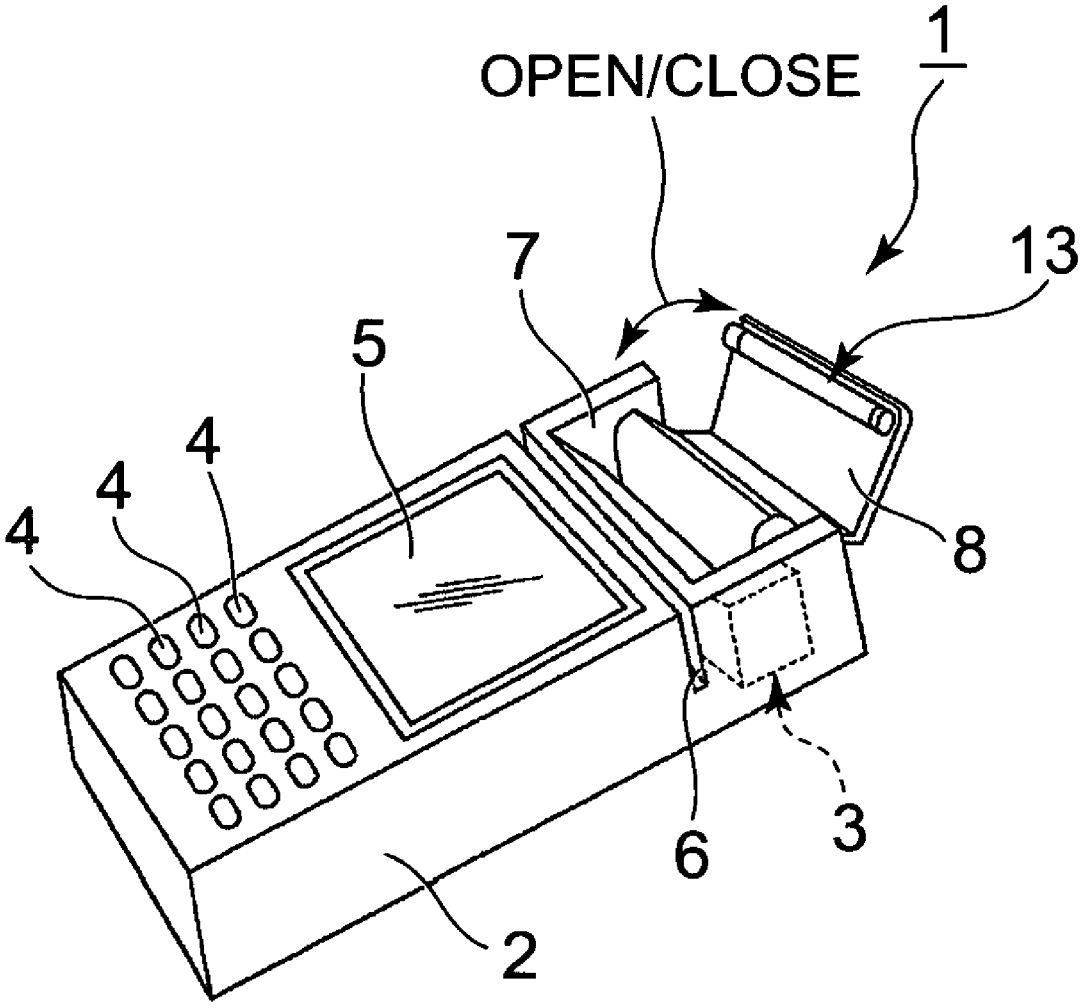
FIG. 1 is an external perspective view of an information terminal including a thermal printer according to the present invention.

Hereinafter, an embodiment according to the present invention is described based on the drawings. FIG. 1 is an external perspective view of an information terminal including a thermal printer according to the present invention. It should be noted that in this embodiment, an example of a case where a thermal printer is mounted to a portable information terminal capable of allowing a home-delivery worker to perform card settlement at a client site is described.

As illustrated in FIG. 1, an information terminal 1 of this embodiment includes a case body 2, a thermal printer 3 accommodated in the case body 2, an input portion 4 including a plurality of key buttons and a liquid crystal display portion 5 for displaying various sorts of information, both of which are provided on a surface of the case body 2, a reading portion 6 for reading data from a magnetic recording portion of a magnetic card (not shown) at a time of insertion of the magnetic card, a recording sheet accommodating portion 7 for accommodating a recording sheet P wound in a roll, a platen roller 13 of the thermal printer 3 provided through an intermediation of a connection mechanism 30 described below, and a cover (lid member) 8 which supports a platen roller 13 of the thermal printer 3 and is capable of opening and closing the recording sheet accommodating portion 7 with the platen roller 13.

Figure 2:
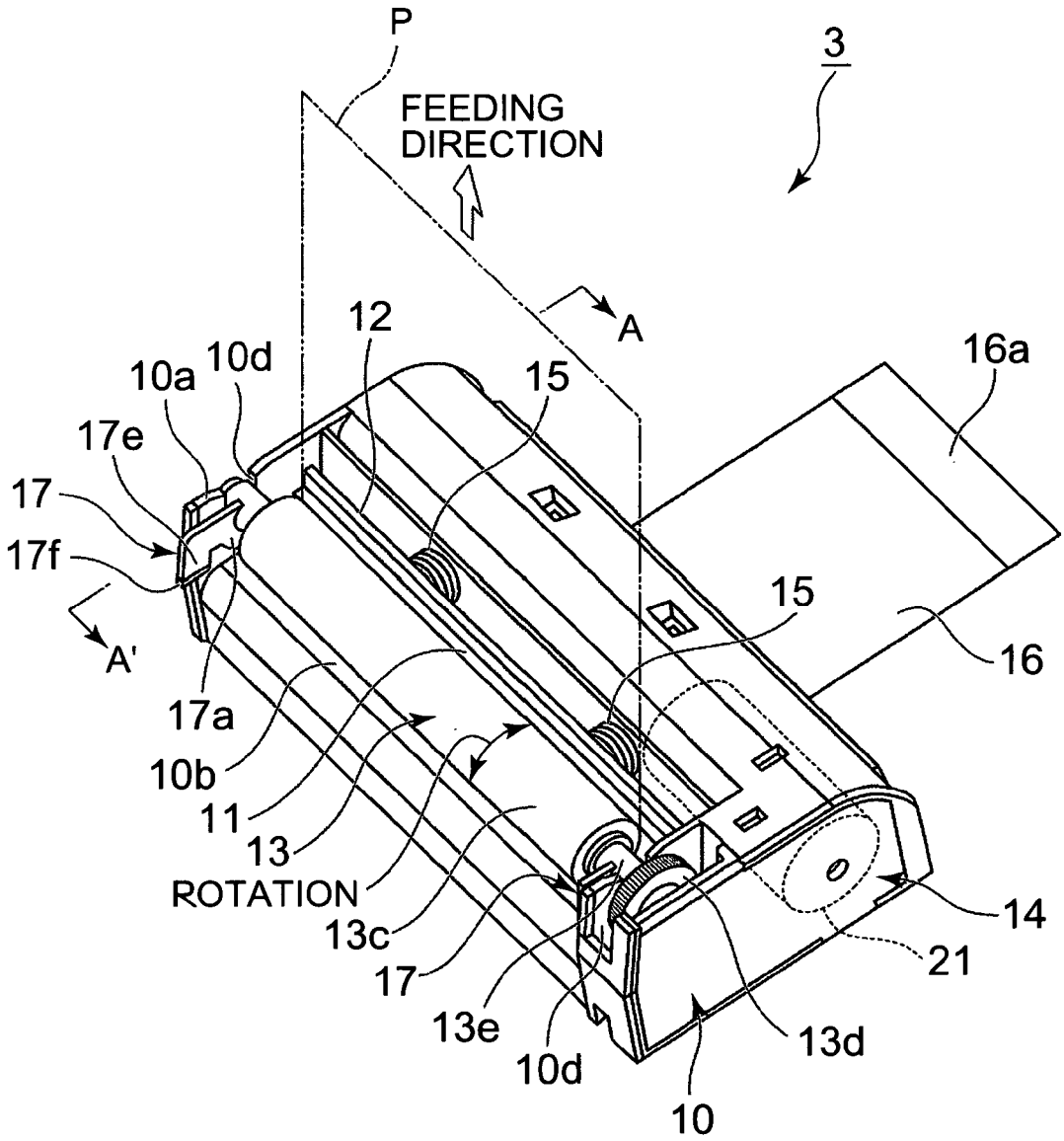
FIG. 2 is an external perspective view of the thermal printer with a platen roller being attached thereto.
Figure 3:
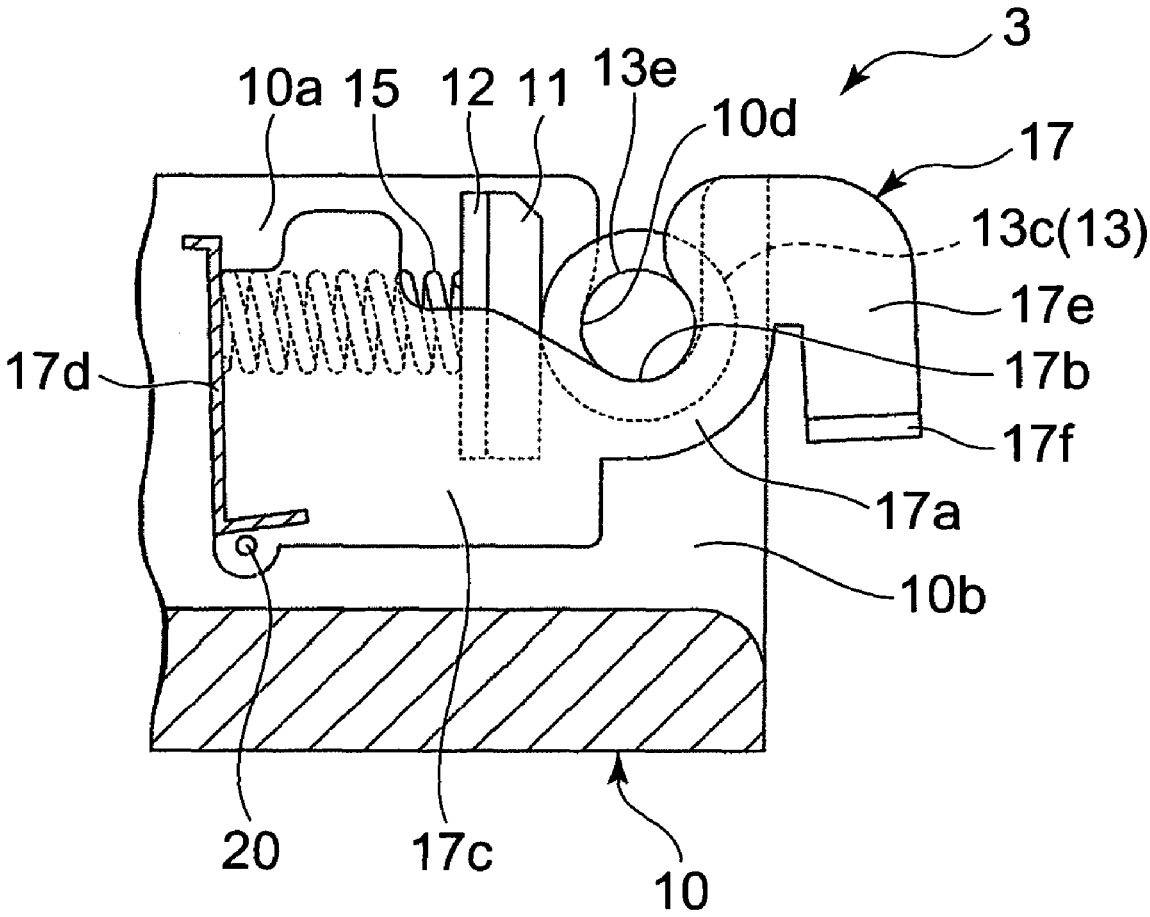
FIG. 3 is a sectional view along a line A-A' illustrated in FIG. 2.

FIG. 2 is an external perspective view of the thermal printer with the platen roller being attached thereto (in a state where the cover is closed), whereas FIG. 3 is a sectional view along a line A-A' illustrated in FIG. 2. Note that, in FIG. 2, the illustration of the recording sheet accommodating portion 7, the cover 8 and the like is omitted for easy understanding of the description.

As illustrated in FIGS. 2 and 3, the thermal printer 3 includes a frame 10 having a pair of side wall portions 10*a* provided opposed to each other in a width direction of the recording sheet P, a thermal head 11 having a plurality of heat-generating elements and which is provided along the width direction of the recording sheet P, a conductive head supporting body 12 for supporting the thermal head 11, the platen roller 13 for feeding the recording sheet P by rotating while sandwiching the recording sheet P with the thermal head 11 in a closed state of the lid member, driving means 14 for rotating the platen roller 13 to feed the recording sheet P, elastic members 15 such as coil springs provided between the frame 10 and the head supporting body 12, for supporting the head supporting body 12 in a state where the head supporting body 12 is biased toward the platen roller 13, and a flexible substrate 16 whose surface is provided with a wiring pattern (not shown) and which is electrically connected to the thermal head 11 to transmit a signal.

The frame 10, which is formed in a substantially rectangular shape, is an injection-molded article of a plastic such as polycarbonate, and is provided with an accommodating portion 10*b* for accommodating the platen roller 13 on an upper surface side thereof. In addition, the frame 10 is mounted so as to be positioned inside the recording sheet accommodating portion 7 (see FIG. 1) in such a manner that the frame 10 is positioned above the recording sheet P wound in a roll. In other words, the recording sheet P is fed toward the upper surface side (upper side in FIG. 3) from the lower surface side (lower side in FIG. 3) of the frame 10. The pair of side wall portions 10*a* are provided opposed to each other with the accommodating portion 10*b* positioning therebetween.

For each of the side wall portions 10*a*, a concave portion (bearing portion) 10*d* formed by cutting an upper circumferential edge of the side wall portion in a height direction is formed. Both end portions of the platen roller 13 are received in the concave portions. On the inner surface sides of the side wall portions 10*a*, a pair of lock arms 17, with which both end portions of the platen rollers 13 are engaged, are respectively provided.

The lock arms 17, each having an approximately C-shape when viewed from the side, include hook portions 17*a* to be engaged with the both end portions of the platen roller 13 to pull the platen roller 13 toward the thermal head 11. For each of the hook portions 17*a*, a concave supporting portion 17*b* (see FIG. 3) for supporting an outer circumferential surface of each of the both ends of the platen roller 13 is formed. Each of the both end portions of the platen roller 13 is sandwiched between the supporting portion 17*b* and a circumferential edge of the concave portion 10*d*. On the rear end side of each of the hook portions 17*a* (on the left in FIG. 3), an arm portion 17*c* (see FIG. 3) extending backward from the hook portion 17*a* is formed. The arm portions 17*c* extend from the hook portions 17*a* provided on both sides of a head supporting body 12 beyond the back of the head supporting body 12 to sandwich both sides of the head supporting body 12 therebetween. On the rear end side of each of the arm portions 17*c* (on the left in FIG. 3), an elastic member supporting portion 17*d* bridging the pair of arm portions 17*c* behind the head supporting body 12 is formed. The elastic member supporting portion 17*d* supports the elastic members 15 described above with the head supporting portion 12, and extend in approximately parallel to the head supporting body 12. The elastic members 15 perform biasing in a direction of separating the head supporting body 12 and the elastic member supporting portion 17*d* away from each other, that is, in a direction of causing the hook portions 17*a* to stand up. In this manner, the both end portions of the platen roller 13 can be respectively locked between the hook portions 17*a* of the lock arms 17 and the circumferential edges of the concave portions 10*d*. Note that the lock arms 17 are turnably supported on the side wall portions 10*a* by a turning shaft 20.

Further, on the front end side of the hook portion 17*a* of one of the pair of lock arms 17, a lever portion 17*e* for operating the lock arm 17 is formed. The lever portion 17*e* is a member extending downward from an upper portion of the hook portion 17*a* at a front end thereof in a handing-down manner. At a distal end of the lever portion 17*e*, an operating piece 17*f* formed by bending the lever portion 17*e* at a right angle is formed. By pushing down the operating piece 17*f*, the elastic member supporting portion 17*d* turns about the turning shaft 20 in a direction of getting closer to the head supporting body 12. Therefore, a structure is such that a distance between the hook portion 17*a* and the concave portion 10*d* is increased to unlock the platen roller 13 and the hook portions 17*a*. Note that, the operating piece 17*f* is configured to follow an operation of opening the cover 8 to be pushed down by unlock means (not shown) provided to the case main body 2 of the information terminal 1 described above.

The platen roller 13 includes a roller main body 13*c* made of rubber or the like provided externally on a roller shaft 13*e*. When the cover 8 is closed through an unillustrated bearing member, the both end portions of the roller shaft 13*e* are respectively fitted between the concave portions 10*d* of the side wall portions 10*a* and the hook portions 17*a* of the lock arms 17 to be rotatably supported. Further, a driven gear 13*d* is fixed to one end portion of the platen roller 13, and meshes with an unillustrated gear transmission mechanism attached to the frame 10 side when supported by the pair of side wall portions 10*a*. The gear transmission mechanism is connected to a motor 21 to transmit a rotary driving force from the motor 21 to the driven gear 13*d*. As a result, the platen roller 13 rotates while being supported by the pair of side wall portions 10*a* to enable the feeding of the recording sheet P from the lower surface side of the frame 10 to the upper surface side thereof. The gear transmission mechanism and the motor 21 constitute the driving means 14 described above.

The thermal head 11 is supported by the head supporting body 12 while being arranged to be opposed to the platen roller 13. The circumferential surface of the platen roller 13 is in contact with the thermal head 11 while the recording sheet P is being interposed therebetween as described above. Further, the elastic members 15 described above are interposed between the head supporting body 12 and the elastic member supporting portion 17*d* of the lock arms 17 described above to perform biasing in a direction of separating the elastic member supporting portion 17*d* and the head supporting body 12 away from each other. Specifically, each of the elastic members 15 is configured to constantly bias the head supporting body 12 toward the platen roller 13.

The flexible substrate 16 carries a wiring pattern formed on its surface. The wiring pattern is appropriately electrically connected to the thermal head 11, the motor 21 or the like. Further, the proximal end side of the flexible substrate 16 serves as a terminal portion 16*a* of the wiring pattern, which is connected to an unillustrated control section of the information terminal 1. In this manner, upon input of electric power, a control signal or the like through the wiring pattern, the thermal head 11 or the motor 21 is operated.

Figure 4:
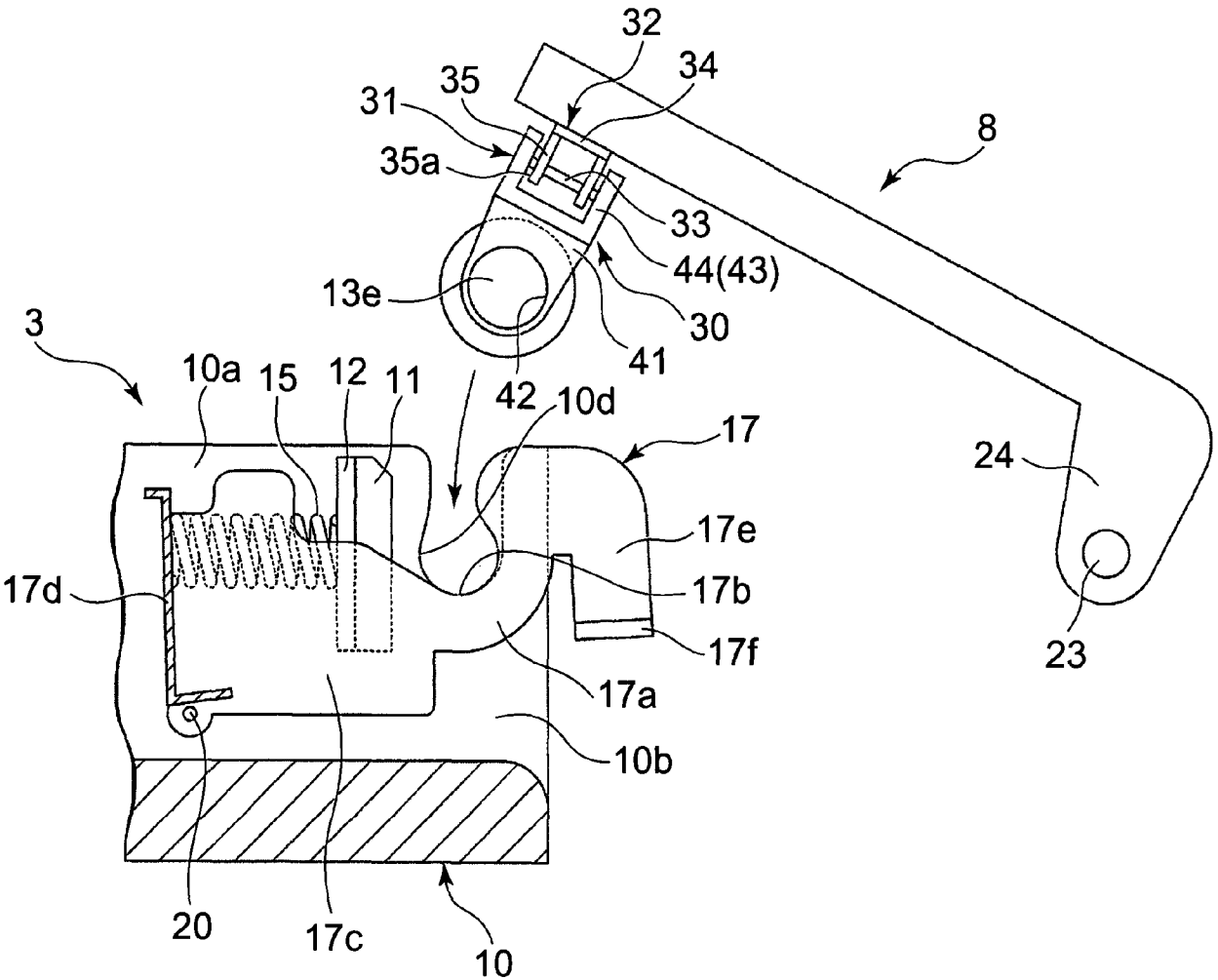
FIG. 4 is a side view of the thermal printer when a cover is in a closed state.
Figure 5:
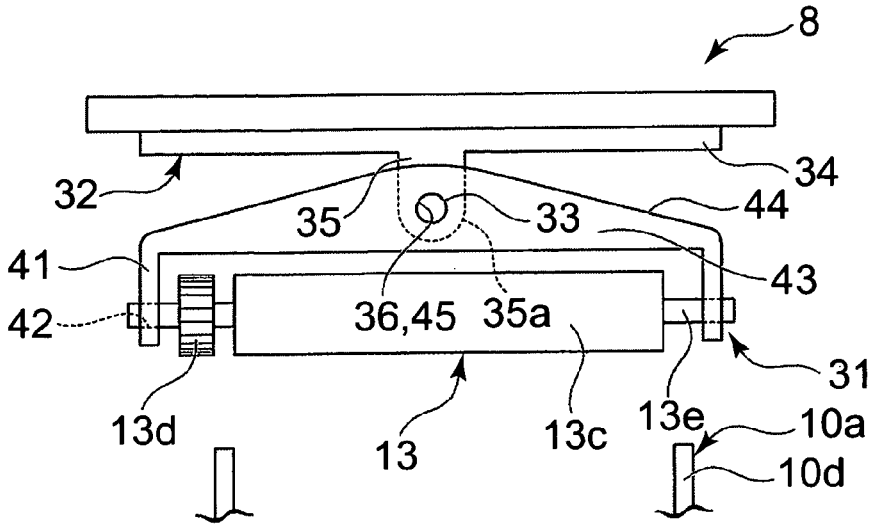
FIG. 5 is a front view of the thermal printer when the cover is in an open state.

FIG. 4 is a side view of the thermal printer in a state where the cover is opened, and FIG. 5 is a front view thereof.

Here, as illustrated in FIGS. 1, 4 and 5, the cover 8 of the information terminal 1 described above is formed by an injection-molded product made of a plastic such as polycarbonate, sheet metal working of a metal or the like as in the case of the frame 10 described above, and is configured to be capable of opening and closing the recording sheet accommodating portion 7. On one end side of the cover 8, a hinge portion 24 protruding in a thickness direction of the cover 8 is formed. A shaft 23 is inserted through the hinge portion 24. The cover 8 is supported turnably with respect to the case main body 2 through the shaft 23. On the other hand, on the other end side (distal end side) of the cover 8, the platen roller 13 described above is provided through a connection mechanism 30. Further, the platen roller 13 is locked to the lock arms 17 along with an operation of closing the cover 8.

The connection mechanism 30 includes a roller bracket 31 for rotatably supporting the platen roller 13, a cover bracket 32 provided on the other end side of the cover 8 to turnably support the roller bracket 31, and a connection pin 33 for connecting the roller bracket 31 and the cover bracket 32 to each other.

First, the cover bracket 32 includes a supporting plate 34 provided on a lower surface (surface opposed to the recording sheet accommodating portion 7 when the cover is in a closed state) of the cover 8 along a width direction of the cover 8. The supporting plate 34 is a flat plate-like member, and is located while its longitudinal direction is aligned with the width direction of the cover 8. In a longitudinal middle portion of the supporting plate 34, a pair of connection portions 35 extending from both sides of the supporting plate 34 in the width direction along the thickness direction are formed.

Each of the connection portions 35 has a semi-circular shape with a curved portion 35*a* on the outer circumferential edge of a distal end thereof. The connection portions 35 extend from both sides of the supporting plate 34 to be opposed to each other in a parallel state. Therefore, the cover bracket 32 is formed to have a C-like shape when viewed from the side (see FIG. 4). Further, through holes 36 penetrating through the pair of connection portions 35 in the thickness direction of the connection portions 35 are formed at the positions to overlap each other.

Figure 6:
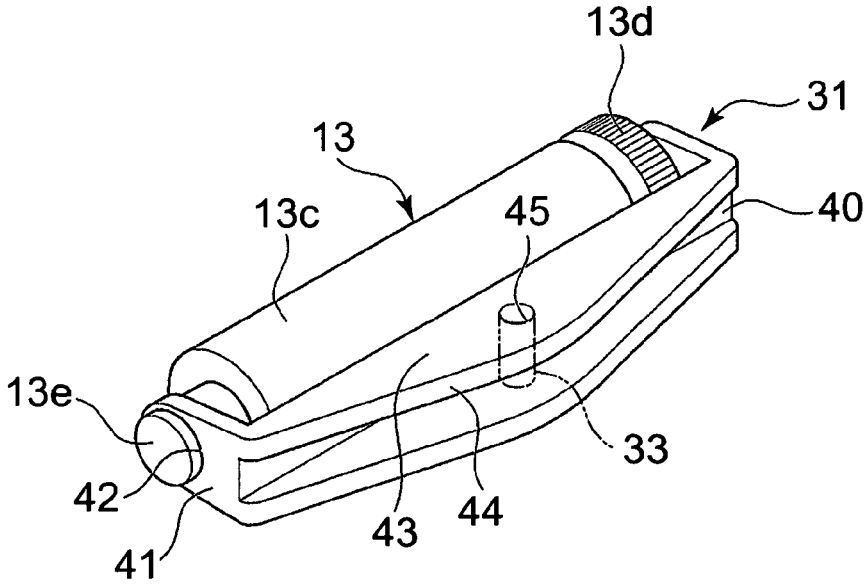
FIG. 6 is a perspective view of the platen roller and the roller bracket.

FIG. 6 is a perspective view of the platen roller and the roller bracket.

As illustrated in FIG. 6, the roller bracket 31 includes a base portion 40 arranged to be opposed to the platen roller 13 with a gap therebetween. The base portion 40 has a flat plate-like shape to extend along an axial direction of the platen roller 13, and is formed to have a larger width than that of the supporting plate 34 of the cover bracket 32 described above. At both longitudinal ends of the base portion 40, a pair of bearing portions 41 for supporting the roller shaft 13*e* of the platen roller are formed. The bearing portions 41 are members extending from outer circumferential edges of the both longitudinal ends of the base portion 40 along the thickness direction, and are arranged to be opposed to each other to sandwich the both axial ends of the platen roller 13. Further, each of the bearing portions 41 is formed to have a triangular shape when viewed from the side, which is gradually tapered from a proximal end toward a distal end. The proximal end (base) of the bearing portion corresponds to a short side of the base portion 40. On the distal end side of the bearing portions 41, through holes 42 penetrating through the bearing portions 41 along the thickness direction are respectively formed at the position to overlap each other. The both ends of the roller shaft 13*e* of the platen roller 13 are inserted through the through holes 42. As a result, the platen roller 13 is rotatably supported.

A pair of back plates 43 connected to the connection portions 35 of the cover bracket 32 are formed on both ends of the base 40 in the width direction. The back plates 43 are members extending from outer circumferential edges of both ends of the base portion 40 in the width direction toward the side opposite to the bearing portions 41 along the thickness direction, and are arranged to be opposed to each other in a parallel state to sandwich the base portion 40 from both sides in the width direction. Each of the back plates 43 is formed to have a triangular shape when viewed from the side, which is gradually tapered from a proximal end toward a distal end. The proximal end (base) of the back plate 43 corresponds to a long side of the base 40, whereas inclined surfaces 44 which are inclined from both longitudinal ends of the base portion 40 toward its distal end is formed. Further, the inclined surfaces 44 intersect each other in a longitudinal middle portion of the base portion 40, and an intersection point constitutes the distal end (top) of the back plate 43. On the distal end side of each of the back plate 43, a through hole 45 penetrating through the back plate 43 in the thickness direction is formed. The through holes 45 are round holes formed through the pair of back plates 43 to overlap each other.

Here, the roller bracket 31 and the cover bracket 32 are fixed to allow the back plates 43 of the roller bracket 31 to cover the outer sides of the connection portions 35 of the cover bracket 32. More specifically, the roller bracket 31 and the cover bracket 32 are fixed while each of the through holes 45 of the back plate 43 and each of the through holes 36 of the connection portions 35 are made to overlap with each other. In the through holes 36 and 45, a columnar connection pin 33 for turnably connecting the roller bracket 31 and the cover bracket 32 to each other is provided. The connection pin 33 is provided in the through holes 36 and 45 to perpendicularly cross the axial direction of the platen roller 13, and has both ends fixed into the through holes 45 of the back plates 43 while being loosely inserted into the through holes 36 of the connection portions 35. As a result, the roller bracket 31 is supported rotatably about the connection pin 33 along an in-plane direction perpendicularly crossing a plane direction of the cover 8. In other words, the roller bracket 31 is connected to the cover bracket 32 by the connection pin 33 provided in a direction perpendicularly crossing the axial direction of the platen roller 13, and is supported turnably in the direction perpendicularly crossing the axial direction of the platen roller 13. Specifically, an axis of rotation of the roller bracket 31 in the connection mechanism 30 is contained in a plane passing through a midpoint between the pair of concave portions 10*d* to be vertical to the axial direction of the concave portions 10*d*, and is arranged parallel to the cover 8.

Further, a gap is provided between each of the connection portions 35 of the cover bracket 32 and each of the back plates 43 of the roller bracket 31. The connection pin 33 slides in the through holes 36 of the connection portions 35 (see an arrow illustrated in FIG. 4). Specifically, the cover bracket 32 and the roller bracket 31 have "play" along the axial direction of the connection pin 33. The roller bracket 31 is movable (slidable) even in the axial direction of the connection pin 33. Therefore, the position of the platen roller 13 is easily aligned with that of the frame 10 to which the thermal head 11 is fixed, and hence the platen roller 13 and the thermal head 11 can be brought into even contact with each other without leaving an excessive stress thereon. As a result, printing precision can be improved.

(Functions)

Next, functions of the connection mechanism of this embodiment are described. In the following description, a method of locking the platen roller 13 when one side of the cover 8 in the width direction is pushed down for closing the cover 8 is described.

Figure 7:
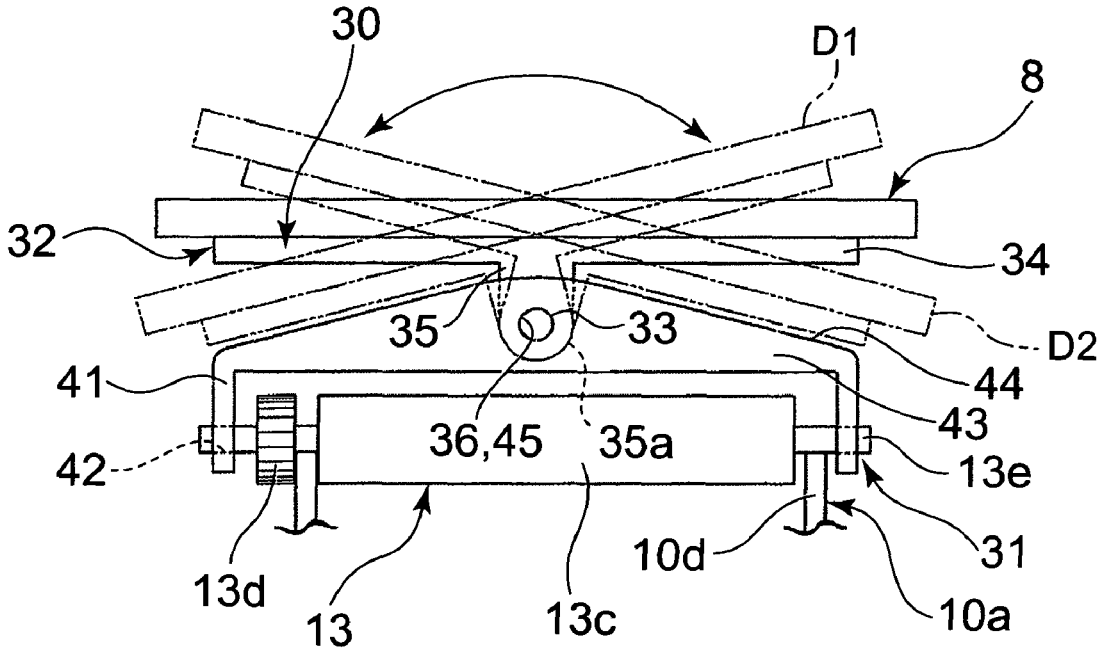
FIG. 7 is a front view illustrating the platen roller and side wall portions when an operation of closing the cover is performed.

FIG. 7 is a front view illustrating the platen roller and the side wall portions when the operation of closing the cover is performed.

First, after the recording sheet P is placed in the recording sheet accommodating portion 7, one side of the cover 8 in the width direction is pushed down while a leading end of the recording sheet P is pulled out toward the downstream side of the thermal head 11, thereby turning the cover in a closing direction. Then, the both end portions of the platen roller 13 provided to the cover 8 are held while abutting against the side wall portions 10*a* and the upper edges of the lock arms 17.

Here, when one side of the cover 8 in the width direction is further pushed down (in the closing direction), the cover 8 becomes twisted (turned) about a direction perpendicularly crossing the shaft 23 in the plane direction as an axis by the push-down force (for example, see chain lines D1 and D2 illustrated in FIG. 7). Specifically, the platen roller 13 and the cover 8 are connected turnably through the connection mechanism 30, and hence the cover 8 turns relative to the platen roller 13 along the in-plane direction perpendicularly crossing the plane direction of the cover 8 while the both end portions of the platen roller 13 abut against the side wall portions 10*a* and the upper edges of the lock arms 17. Then, the push-down force for pushing down the cover 8 is transmitted from the cover bracket 32 through the connection pin 33 to the roller bracket 31. The force (above-mentioned push-down force) transmitted to the roller bracket 31 acts through the bearing portions 41 in a direction perpendicularly crossing the axial direction of the roller shaft 13*e*. As a result, the platen roller 13 is evenly pushed down at the both end portions of the roller shaft 13*e*.

Then, an outer circumferential surface of the roller main body 13*c* of the pushed-down platen roller 13 fits into the concave portions 10*d* while sliding on the surface of the thermal head 11, which is opposed to the platen roller 13. More specifically, when the cover 8 is pushed down, the both end portions of the roller shaft 13*e* enter between the concave portions 10*d* and the lock arms 17, respectively. As a result, the lock arms 17 turn about the turning shaft 20 to gradually increase a distance between the concave portion 10*d* and the lock arm 17. In this case, when the lock arms 17 turn, the elastic members 15 interposed between the elastic member supporting portion 17*d* and the head supporting body 12 are reduced in length to generate an elastic force (restoring force) in the elastic members 15. Then, when the both end portions of the roller shaft 13*e* fully get into the concave portions 10*d*, the reduced elastic members 15 extend to turn the lock arms 17 in a direction of sandwiching the both end portions of the roller shaft 13*e*. The supporting portions 17*b* of the lock arms 17 and the outer circumferential surface of the roller shaft 13*e* come into contact with each other at the time of turning, thereby making a clicking engagement sound. The both end portions of the roller shaft 13*e* are engaged approximately simultaneously in this embodiment, and hence the engagement sounds for the engagements between the pair of lock arms 17 and the both end portions of the roller shaft 13*e* are simultaneously made. Specifically, when the engagement sounds are made, it can be judged that the both ends of the roller shaft 13*e* are locked to be in a both-end locked state.

Moreover, with the locking of the both end portions of the roller shaft, the cover 8 is fully closed to close the recording sheet accommodating portion 7. As a result, the both end portions of the platen roller 13 are fully received in the concave portions 10*d* of the side wall portions 10*a* while sandwiching the recording sheet P with the thermal head 11, and are held while being fitted between the outer circumferential edges of the concave portions 10*d* and the hook portions 17*a* of the lock arms 17. As a result, along with the operation of closing the cover 8, the both end portions of the platen roller 13 are substantially simultaneously locked.

(Method of Operating the Thermal Printer)

Next, a method of operating the thermal printer is described.

After the cover 8 is closed to lock the platen roller 13, the thermal printer 3 is operated to rotate the platen roller 13. Then, the recording sheet P pulled out from the roll paper with the rotation of the roller paper is fed toward the downstream side while being sandwiched between the circumferential surface of the platen roller 13 and the thermal head 11. At the same time, various characters, graphics and the like can be clearly printed on the fed recording sheet P by the thermal head 11 including the large number of heat-generating elements which appropriately generate heat. As a result, the recording sheet P can be used as a receipt, a ticket or the like.

Note that, for opening the cover 8, the unlock means provided to the case main body 2 is operated. More specifically, when the unlock means is operated, the operating piece 17*f* of the lock arm 17 is pushed down. As a result, the both end portions 13*a* and 13*b* of the platen roller 13 are unlocked by the hook portions 17*a*. At this time, the elastic member supporting portion 17*d* provided to the lock arm 17 gets closer to the thermal head 11 to reduce the elastic members 15 in length, thereby generating the elastic force in the elastic members 15. Then, the elastic force is transmitted to the platen roller 13 through the thermal head 11 to push out the platen roller 13 from the concave portions 10*d*. Therefore, the cover 8 turns about the shaft 23 to enable the cover 8 to be opened.

As described above, in this embodiment, the structure is such that the connection mechanism 30 for connecting the platen roller 13 and the cover 8 to each other in the axial middle portion of the platen roller 13 is provided between the platen roller 13 and the cover 8 to be turned about the connection pin 33 along the in-plane direction perpendicularly crossing the plane direction of the cover 8.

According to the structure described above, even when one side of the cover 8 in the width direction is pushed down (in the closing direction), the push-down force for pushing down the cover 8 is transmitted from the cover bracket 32 through the connection pin 33 to the roller bracket 31. Specifically, since the force for pushing down the cover 8 is transmitted through the connection pin 33 without fail, the push-down force acts downward on the axial middle portion of the platen roller 13 even when a portion other than the middle portion of the cover 8 in the width direction is pushed down. Then, the force (above-mentioned push-down force and restoring force) transmitted through the connection pin 33 to the roller bracket 31 acts on the roller shaft 13*e* through the bearing portions 41 in the direction perpendicularly crossing the axial direction of the roller shaft 13*e*. As a result, the platen roller 13 is evenly pushed down at the both end portions of the roller shaft 13*e*. Therefore, the both end portions of the platen roller 13 can be substantially simultaneously locked along with the operation of closing the cover 8. Specifically, whenever the clicking engagement sound is made, it can be judged that both ends of the platen roller are locked.

Therefore, the platen roller 13 and the thermal head 11 are brought into even contact with each other, and hence the recording sheet P can be continuously fed by the platen roller 13. As a result, accurate printing with high precision can be performed on the recording sheet P. Moreover, even when one side of the cover 8 in the width direction is pushed down, the one-side locked state as occurring in the conventional cases can be prevented. Therefore, it is not necessary to consciously push down the middle portion of the cover 8 in the width direction or to confirm the locked state after the closing operation. Thus, with improvement in operability, the both end portions of the platen roller 13 can be reliably locked to the concave portions 10*d* of the frame 10.

Moreover, the roller bracket 31 is configured to be slidable in the axial direction of the connection pin 33, and hence a dimension error between the connection mechanism 30 and the frame 10 can be allowed. Specifically, even when the roller shaft 13*e* of the platen roller 13 and the concave portions 10*d* of the side wall portions 10*a* are misaligned in the width direction of the concave portions 10*d* at the time of the operation of closing the cover 8, the roller bracket 31 slides in the axial direction of the connection pin 33 to allow the both end portions of the platen roller to reliably move into the concave portions 10*d*. As a result, even when the dimension error is generated between the connection mechanism 30 and the frame 10, the both end portions of the platen roller 13 can be reliably locked to the concave portions 10*d* of the frame 10 while the platen roller 13 and the thermal head 11 are brought into even contact with each other.

Note that the technical scope of the present invention is not limited to the embodiment described above, and various changes are possible without departing from the spirit of the present invention.

For example, although the description has been made of the roll paper formed by winding the recording sheet to have the hollow in this embodiment, the roll paper formed by winding the recording sheet around a core tube may also be used.

Moreover, although the case where the thermal printer 3 is used for the information terminal 1 has been described in this embodiment, the use of the thermal printer is not limited thereto. For example, the thermal printer can also be used for a checkout machine at a parking or that of an oil dispenser at a self-service gas station, a ticket-vending machine provided in various restaurants, and the like.

Furthermore, although the case where the roller bracket 31 and the cover bracket are turnably connected by the connection pin has been described in this embodiment, the structure may also be such that the roller bracket and the cover bracket are connected by a ball or the like.

What is claimed is:

1. A thermal printer comprising:

a case having an opening portion for accommodating a recording sheet therein;

a thermal head for performing printing on the recording sheet;

a lid member capable of opening and closing the opening portion of the case;

a platen roller provided to the lid member, for feeding the recording sheet through a rotation of the platen roller while sandwiching the recording sheet with the thermal head when the lid member is in a closed state;

a frame provided in the case to support the thermal head;

a pair of bearing portions provided to the frame to receive both end portions of a shaft of the platen roller when the lid member is in the closed state;

a pair of lock arms for automatically engaging the shaft of the platen roller with the bearing portions along with an operation of closing the lid member; and a connection mechanism for turnably connecting the platen roller to the lid member, wherein an axis of rotation of the platen roller in the connection mechanism is contained in a plane passing through a midpoint between the pair of bearing portions to be vertical to an axial direction of the bearing portions and is arranged parallel to the lid member.

2. A thermal printer according to claim 1, wherein the connection mechanism supports the platen roller movably along an axial direction of the axis of rotation.

* * * * *